US010483639B2

(12) United States Patent
Lee

(10) Patent No.: US 10,483,639 B2
(45) Date of Patent: Nov. 19, 2019

(54) COMMUNICATION DEVICE AND ANTENNA ASSEMBLY THEREOF

(71) Applicant: ASUSTEK COMPUTER INC., Taipei (TW)

(72) Inventor: Cheng-Tse Lee, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 0 days.

(21) Appl. No.: 16/018,471

(22) Filed: Jun. 26, 2018

(65) Prior Publication Data

US 2018/0375208 A1 Dec. 27, 2018

(30) Foreign Application Priority Data

Jun. 27, 2017 (TW) ..... 106121456 A

(51) Int. Cl.
*H01Q 5/30* (2015.01)
*H01Q 5/15* (2015.01)
(Continued)

(52) U.S. Cl.
CPC ..... *H01Q 5/15* (2015.01); *H01Q 1/38* (2013.01); *H01Q 5/307* (2015.01); *H01Q 5/314* (2015.01);
(Continued)

(58) Field of Classification Search
CPC ..... H01Q 1/243; H01Q 1/38; H01Q 1/273; H01Q 5/30–5/50; H01Q 13/10
(Continued)

(56) References Cited

U.S. PATENT DOCUMENTS 8,223,083 B2 7/2012 Wong
8,723,740 B2 5/2014 Chiu
(Continued)

FOREIGN PATENT DOCUMENTS

| | | | |
|---|---|---|---|
| CN | 204011719 | U | 12/2014 |
| CN | 104821428 | A | 8/2015 |
| CN | 106374192 | A | 2/2017 |
| TW | 201312850 | A | 3/2013 |
| TW | 201619755 | A | 6/2016 |
| TW | 201635636 | A | 10/2016 |

*Primary Examiner* — Dameon E Levi
*Assistant Examiner* — Hasan Z Islam
(74) *Attorney, Agent, or Firm* — Muncy, Geissler, Olds & Lowe, P.C.

(57) ABSTRACT

The invention discloses a communication device and an antenna assembly thereof. The communication device includes a metal rim, a device metal member, and an antenna assembly. The device metal member is disposed in the metal rim. The antenna assembly includes an insulating substrate, two electrical coupling portions, a feeding part, and a feeding signal source. The insulating substrate is disposed between the device metal member and the metal rim. The two electrical coupling portions are disposed at two opposite ends of the insulating substrate and electrically coupled to the device metal member and the metal rim. The feeding part is disposed on the insulating substrate and electrically coupled to the metal rim, so as to form a first slot section and a second slot section. The feed part is electrically coupled to the metal rim. The feeding signal source is disposed on the insulating substrate, located between the feeding part and the device metal member, and electrically coupled to the feeding part and the device metal member.

10 Claims, 13 Drawing Sheets

(51) Int. Cl.

| | |
|---|---|
| ***H01Q 13/10*** | (2006.01) |
| ***H01Q 5/307*** | (2015.01) |
| ***H01Q 1/38*** | (2006.01) |
| ***H01Q 5/314*** | (2015.01) |
| ***H01Q 5/50*** | (2015.01) |
| *H01Q 1/24* | (2006.01) |
| *H01Q 1/27* | (2006.01) |

(52) U.S. Cl.
CPC ..... *H01Q 5/50* (2015.01); *H01Q 13/10* (2013.01); *H01Q 13/106* (2013.01); *H01Q 1/243* (2013.01); *H01Q 1/273* (2013.01)

(58) Field of Classification Search
USPC ..... 343/702
See application file for complete search history.

(56) References Cited

U.S. PATENT DOCUMENTS

| | | | | |
|---|---|---|---|---|
| 9,601,824 | B2 * | 3/2017 | Apaydin | H01Q 5/328 |
| 2010/0123632 | A1 * | 5/2010 | Hill | H01Q 1/243 343/702 |
| 2012/0256808 | A1 * | 10/2012 | Owens | H01Q 1/2233 343/872 |
| 2014/0266920 | A1 | 9/2014 | Tran et al. | |
| 2017/0048991 | A1 | 2/2017 | Kim et al. | |
| 2017/0062912 | A1 | 3/2017 | Shewan et al. | |
| 2018/0115069 | A1 | 4/2018 | Mai | |

* cited by examiner

COMMUNICATION DEVICE AND ANTENNA ASSEMBLY THEREOF

CROSS-REFERENCE TO RELATED APPLICATION

This application claims the priority benefit of Taiwan application serial No. 106121456, filed on Jun. 27, 2018. The entirety of the above-mentioned patent application is hereby incorporated by reference herein and made a part of specification.

BACKGROUND OF THE INVENTION

Field of the Invention

The invention relates to a communication device and an antenna assembly thereof, and in particular, to a communication device having a sealed slot section and an antenna assembly thereof.

Description of the Related Art

Recently, mobile devices having a communications function such as notebook computers, tablet computers, and mobile phones are requested to have a simple appearance, therefore, the antennas disposed in the existing mobile devices are mainly embedded antennas. The embedded antennas are mainly disposed inside housings. However, when materials of the housings are metal, the radiation performance of the antennas is reduced. In addition, to prevent the radiation performance of an antenna from being affected by a metal housing, a design in which the antenna is disposed on a device body of a device also exists. However, the existing mobile devices have a requirement on portability with lightness and thinness. Therefore, a space for disposing the antenna is usually reduced, and the radiation performance of the antenna is even affected.

BRIEF SUMMARY OF THE INVENTION

According to a first aspect, a communication device is provided. The communication device includes a metal rim, a device metal member, and an antenna assembly. The device metal member is disposed in the metal rim.

The antenna assembly includes an insulating substrate, two electrical coupling portions, a feeding part, and a feeding signal source. The insulating substrate is disposed between the device metal member and the metal rim. The two electrical coupling portions are disposed at two opposite ends of the insulating substrate and electrically coupled to the device metal member and the metal rim, so that the two electrical coupling portions, the device metal member, and the metal rim enclose a sealed slot section. The feeding part is disposed on the insulating substrate and electrically coupled to the metal rim, so as to divide the sealed slot section into a first slot section and a second slot section whose length is less than that of the first slot section. The feeding part is used for activating resonance modes of the first slot section in a first frequency band and a second frequency band and activating a resonance mode of the second slot section in a third frequency band. The feeding signal source is disposed on the insulating substrate, located between the feeding part and the device metal member, and electrically coupled to the feeding part and the device metal member.

According to a second aspect of the disclosure, an antenna assembly is provided herein. The antenna assembly is disposed in a communication device. The communication device includes a metal rim and a device metal member, the device metal member is disposed in the metal rim, and the antenna assembly includes an insulating substrate, two electrical coupling portions, a feeding part, and a feeding signal source. The insulating substrate is disposed between the device metal member and the metal rim. The two electrical coupling portions are disposed at two opposite ends of the insulating substrate and electrically coupled to the device metal member and the metal rim, so that the two electrical coupling portions, the device metal member, and the metal rim enclose a sealed slot section. The feeding part is disposed on the insulating substrate and electrically coupled to the metal rim, so as to divide the sealed slot section into a first slot section and a second slot section whose length is less than that of the first slot section, and the feeding part is used for activating a resonance mode of the first slot section in a first frequency band and activating a resonance mode of the second slot section in a second frequency band. The feeding signal source is disposed on the insulating substrate, located between the feeding part and the device metal member, and electrically coupled to the feeding part and the device metal member.

As described above, in the invention, the antenna assembly is disposed in a sealed space enclosed by the metal rim and the device metal member, and the two electrical coupling portions of the antenna assembly are used to enclose the sealed slot section, so that the insulating substrate disposed in the sealed slot section can be divided into the first slot section and the second slot section by the feeding part, thereby generating resonance modes in different frequency bands in a limited space.

DETAILED DESCRIPTION OF THE EMBODIMENTS

Specific implementations of the invention are described below in more details with reference to schematic diagrams. The advantages and features of the invention are clearer according to the following descriptions and the scope of this application. It should be noted that the accompanying drawings all use very simple forms and imprecise proportions, and are only intended to help describe embodiments of the invention easily and clearly.

Figure 1:
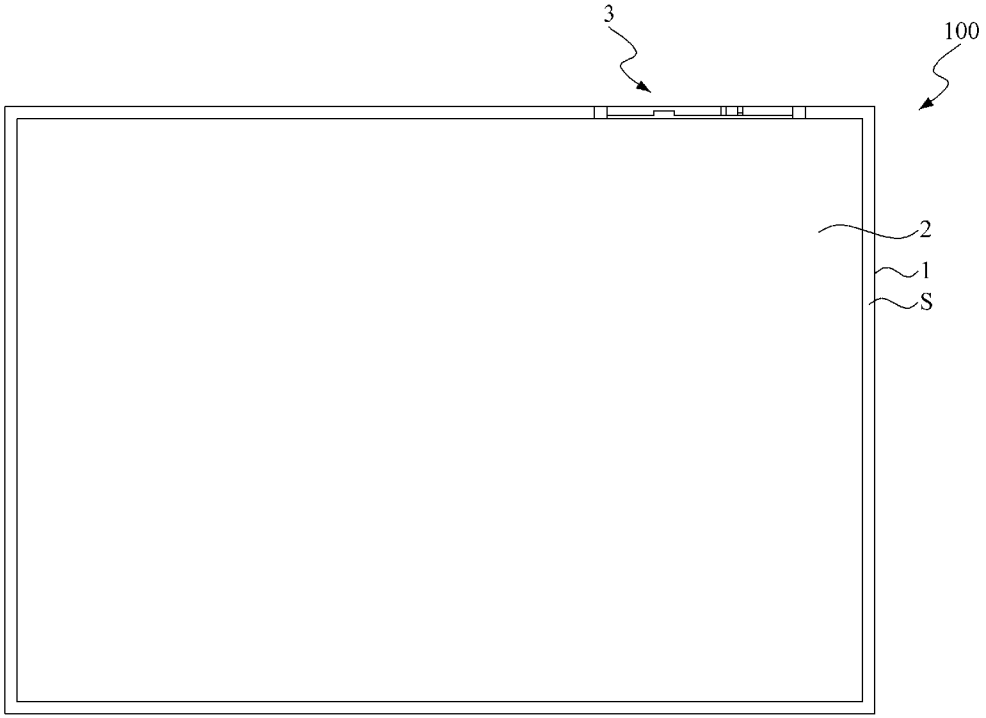
FIG. 1 is a schematic plan view of a communication device according to a first embodiment of the invention.
Figure 2:
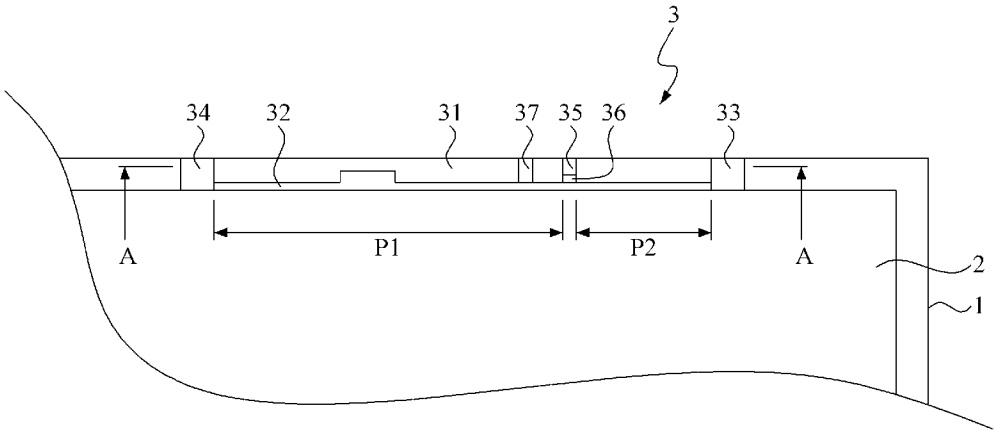
FIG. 2 is a partially enlarged schematic diagram of FIG. 1.
Figure 3:
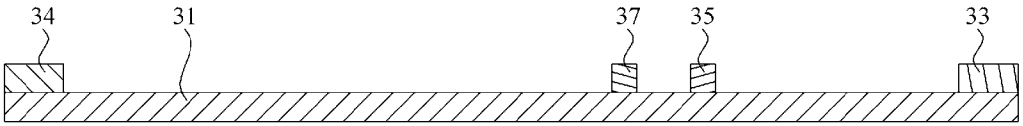
FIG. 3 is a schematic sectional view of FIG. 2 along A-A.

Referring to FIG. 1 to FIG. 3, FIG. 1 is a schematic plan view of a communication device according to a first embodiment of the invention; FIG. 2 is a partially enlarged schematic diagram of FIG. 1; and FIG. 3 is a schematic sectional view of FIG. 2 along A-A. As shown in the figures, a communication device 100 includes a metal rim 1, a device metal member 2, and an antenna assembly 3. The communication device 100 in this embodiment is a notebook computer.

The metal rim 1 in this embodiment is a screen housing. The device metal member 2 is disposed in the metal rim 1, and the device metal member 2 and the metal rim 1 enclose a sealed space S. In this embodiment, the device metal member 2 is a metal panel inside the screen, and the distance between the metal rim 1 and the device metal member 2 is 5 mm.

The antenna assembly 3 includes an insulating substrate 31, a grounding part 32, two electrical coupling portions 33 and 34, a feeding part 35, a feeding signal source 36, and a matching part 37.

The insulating substrate 31 is disposed between the device metal member 2 and the metal rim 1. The grounding part 32 is disposed on the insulating substrate 31 and electrically coupled to the device metal member 2. During actual application, the insulating substrate 31 is an epoxy resin fiberglass substrate (FR4).

The two electrical coupling portions 33 and 34 are disposed at two opposite ends of the insulating substrate 31 and electrically coupled to the grounding part 32, the device metal member 2, and the metal rim 1, so that the two electrical coupling portions 33 and 34, the grounding part 32, and the metal rim 1 enclose a sealed slot section P.

The feeding part 35 is disposed on the insulating substrate 31 and electrically coupled to the metal rim 1, so as to divide the sealed slot section P into a first slot section P1 and a second slot section P2 whose length is less than that of the first slot section P1, and the feeding part 35 is configured to activate a resonance mode of the first slot section P1 in a first frequency band and activate a resonance mode of the second slot section P2 in a second frequency band. In this embodiment, the slot length of the first slot section P1 is 50 mm, and the slot length of the second slot section P2 is 20 mm.

The feeding signal source 36 is disposed on the insulating substrate 31, located between the feeding part 35 and the grounding part 32, and electrically coupled to the feeding part 35 and the grounding part 32, so as to be electrically coupled to the device metal member 2 by using the grounding part 32.

Based on the foregoing descriptions, the insulating substrate 31 is not electrically conductive. Therefore, the insulating substrate 31 in the first slot section P1 enclosed by the metal rim 1, the electrical coupling portion 33, the feeding part 35, the feeding signal source 36, and the grounding part 32 is equivalent to a sealed slot in an electrically conductive structure. Similarly, the insulating substrate 31 in the second slot section P2 enclosed by the metal rim 1, the electrical coupling portion 34, the feeding part 35, the feeding signal source 36, and the grounding part 32 is equivalent to another sealed slot in the electrically conductive structure.

During actual application, although the insulating substrate 31 enclosed by conductors such as the metal rim 1, the two electrical coupling portions 33 and 34, and the grounding part 32 is considered as a sealed slot in an electrically conductive structure, because a dielectric constant of the insulating substrate 31 is still different from a dielectric constant in vacuum or in the air, the slot lengths of the first slot section P1 and the second slot section P2 are less than 0.5 time a wavelength of an operation frequency. In an embodiment, the slot length of the first slot section P1 in this embodiment is 50 mm, the slot length is less than 0.5 time a wavelength (approximately 60 mm) of the first slot section P1 activated in the first frequency band (for example, 2.4 GHz). Similarly, although the slot length of the second slot section P2 in this embodiment is 20 mm, the slot length is less than 0.5 time a wavelength (approximately 30 mm) of the second slot section P2 activated in the second frequency band (for example, 5 GHz).

The matching part 37 is disposed in the first slot section P1, adjacent to the feeding part 35, and electrically coupled to the metal rim 1 and the grounding part 32, so as to be electrically coupled to the device metal member 2 by using the grounding part 32. The matching part 37 is used for optimizing the operation frequency and a frequency bandwidth of the resonance mode generated by the first slot section P1 or the second slot section P2. In addition, during actual application, the matching part 37 is an element such as a resistor, an inductor, or a capacitor.

Figure 4:
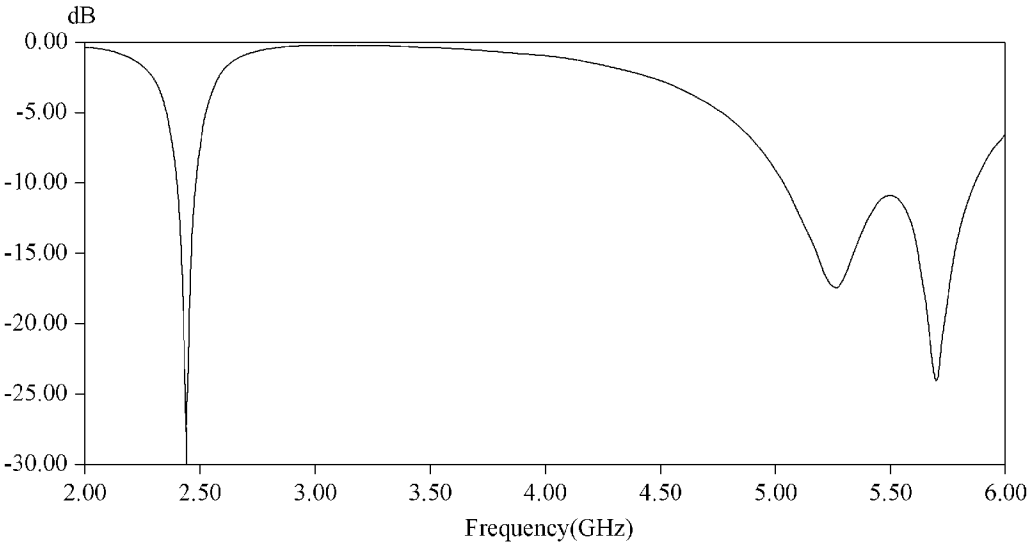
FIG. 4 is a diagram of return loss of a communication device at various operation frequencies according to a first embodiment of the invention.

Continuing to refer to FIG. 4, FIG. 4 is a diagram of return loss of the communication device at various operation frequencies according to the first embodiment of the invention. As shown in the figure, the communication device 100 provided in the embodiment has three resonance modes. The three resonance modes includes a resonance mode of resonance generated by the first slot section P1 in a first frequency band (approximately 2.4 GHz), a resonance mode of resonance generated by the first slot section P1 in a second frequency band (approximately 5.2 GHz), and a resonance mode of resonance generated by the second slot section P2 in a third frequency band (approximately 5.8 GHz), and the three resonance modes can be applied to a wireless LAN (WLAN). It can be learned that in the invention, a resonance mode can be generated indeed by using the antenna assembly 3 disposed between the metal rim 1 and the device metal member 2.

Figure 5:
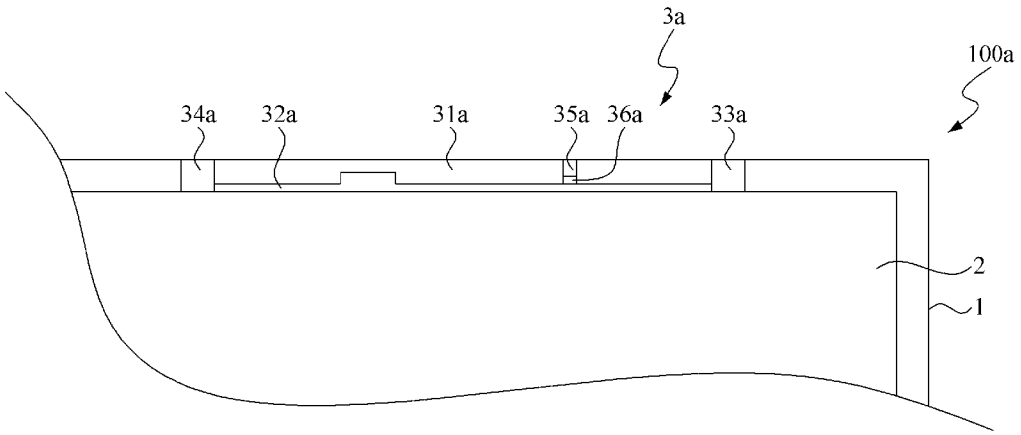
FIG. 5 is a partially enlarged schematic plan view of a communication device according to a second embodiment of the invention.
Figure 6:
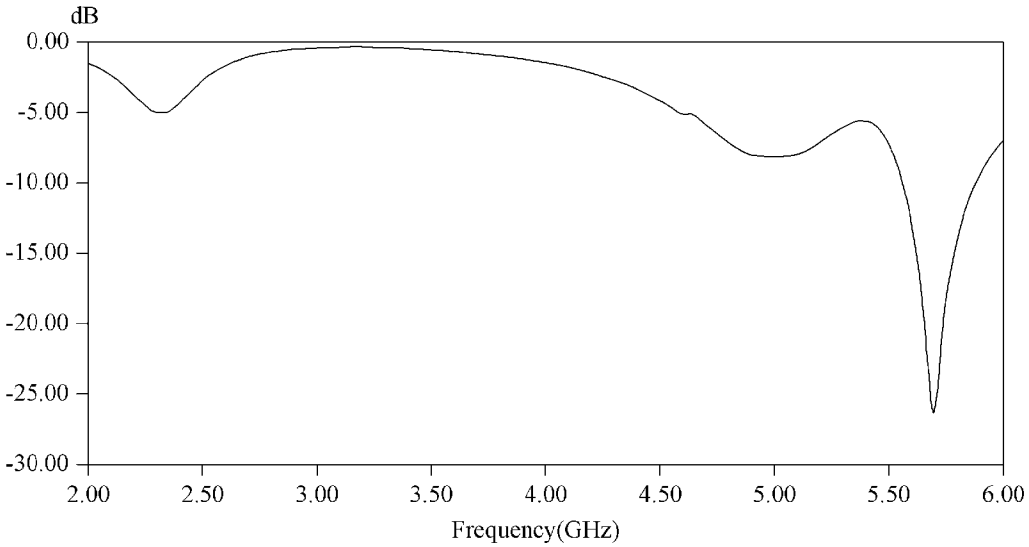
FIG. 6 is a diagram of return loss of a communication device at various operation frequencies according to a second embodiment of the invention.

Continuing to refer to FIG. 5 and FIG. 6, FIG. 5 is a partially enlarged schematic plan view of a communication device according to a second embodiment of the invention; and FIG. 6 is a diagram of return loss of the communication device at various operation frequencies according to the second preferred embodiment of the invention.

As shown in the figures, a communication device 100*a* includes a metal rim 1, a device metal member 2, and an antenna assembly 3*a*. The communication device 100*a* is similar to the communication device 100 provided in the first embodiment. The antenna assembly 3*a* also includes an insulating substrate 31*a*, a grounding part 32*a*, two electrical coupling portions 33*a* and 34*a*, a feeding part 35*a*, and a feeding signal source 36*a*. Compared with the antenna assembly 3, the antenna assembly 3*a* has no matching part 37, and return loss of the antenna assembly 3*a* having no matching part 37 at various operation frequencies is shown in FIG. 6.

Figure 7:
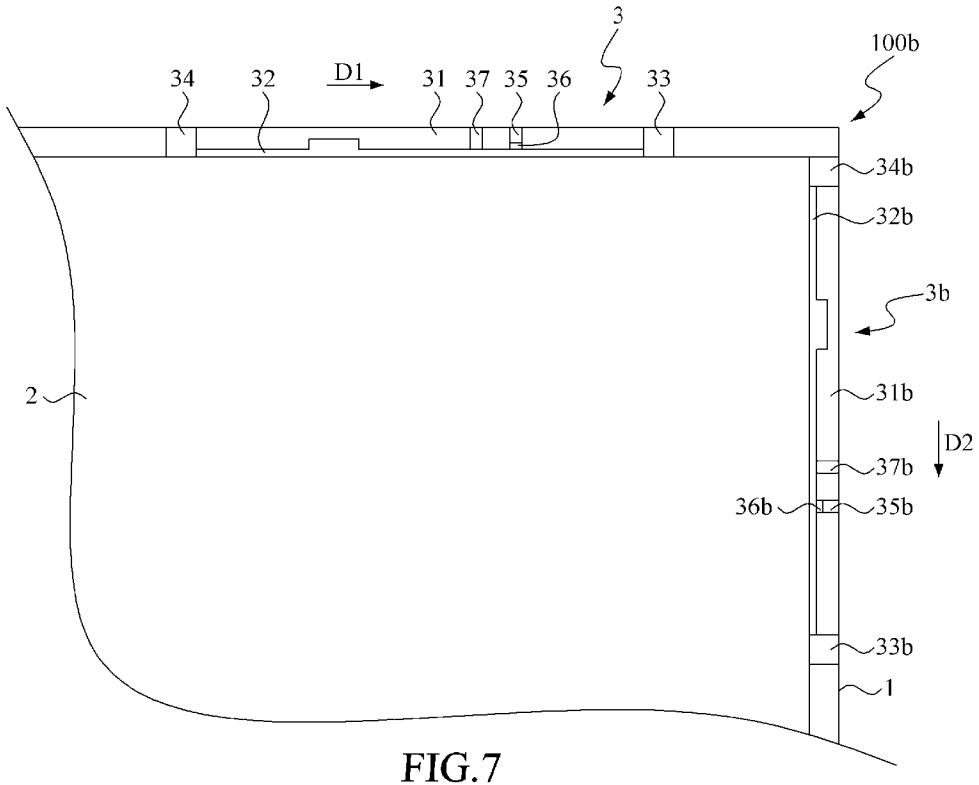
FIG. 7 is a partially enlarged schematic plan view of a communication device according to a third embodiment of the invention.
Figure 8:
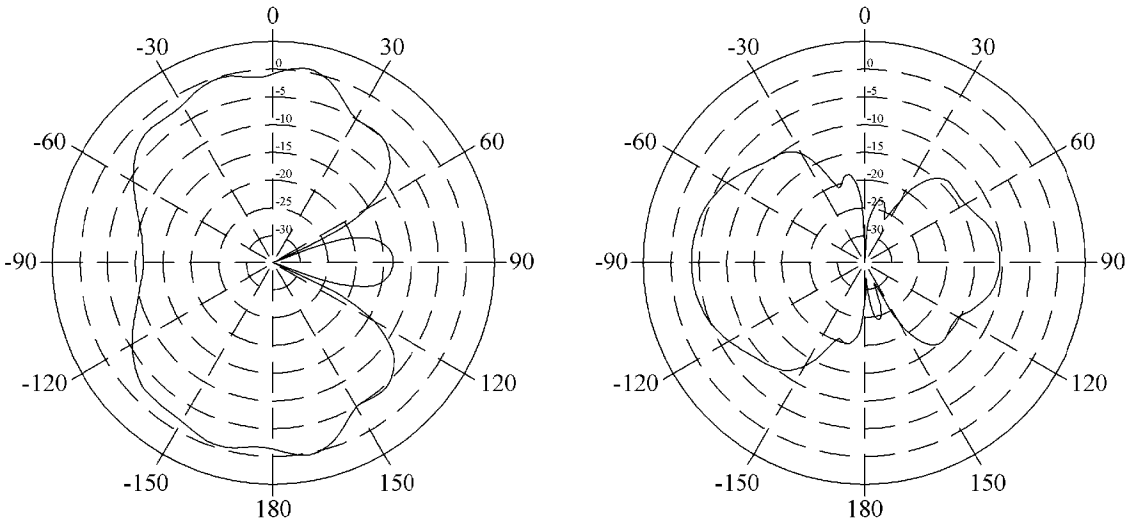
FIG. 8 is a diagram of radiation patterns of an antenna assembly and a complementary antenna assembly of a communication device according to a third embodiment of the invention.

Continuing to refer to FIG. 7 and FIG. 8, FIG. 7 is a partially enlarged schematic plan view of a communication device according to a third embodiment of the invention; and FIG. 8 is a diagram of radiation patterns of an antenna assembly and a complementary antenna assembly of the communication device according to the third embodiment of the invention.

As shown in the figures, a communication device 100*b* includes a metal rim 1, a device metal member 2, an antenna assembly 3, and a complementary antenna assembly 3*b*. Compared with the communication device 100 provided in the first embodiment, the communication device 100*b* further includes the complementary antenna assembly 3*b*. The complementary antenna assembly 3*b* has a structure similar to that of the antenna assembly 3, and the complementary antenna assembly 3*b* also includes an insulating substrate 31*b*, a grounding part 32*b*, two electrical coupling portions 33*b* and 34*b*, a feeding part 35*b*, a feeding signal source 36*b*, and a matching part 37*b*.

The difference between the antenna assembly 3 and the complementary antenna assembly 3*b* is that an insulating substrate 31 of the antenna assembly 3 extends in a first direction D1, and an insulating substrate 31*b* of the complementary antenna assembly 3*b* extends in a second direction D2 perpendicular to the first direction D1. Because the antenna assembly 3 and the complementary antenna assembly 3*b* extend in different directions, radiation patterns generated by the antenna assembly 3 and the complementary antenna assembly 3*b* can be complementary. A radiation pattern on the left of FIG. 8 is a 2.45 GHz radiation pattern of the antenna assembly 3, and a radiation pattern on the right of FIG. 8 is a 2.45 GHz radiation pattern of the complementary antenna assembly 3*b*.

In addition, in another embodiment, two groups of antenna assemblies 3 can alternatively be disposed on the communication device 100*b* in the first direction D1, to increase the radiant intensity in the first direction D1.

Figure 9:
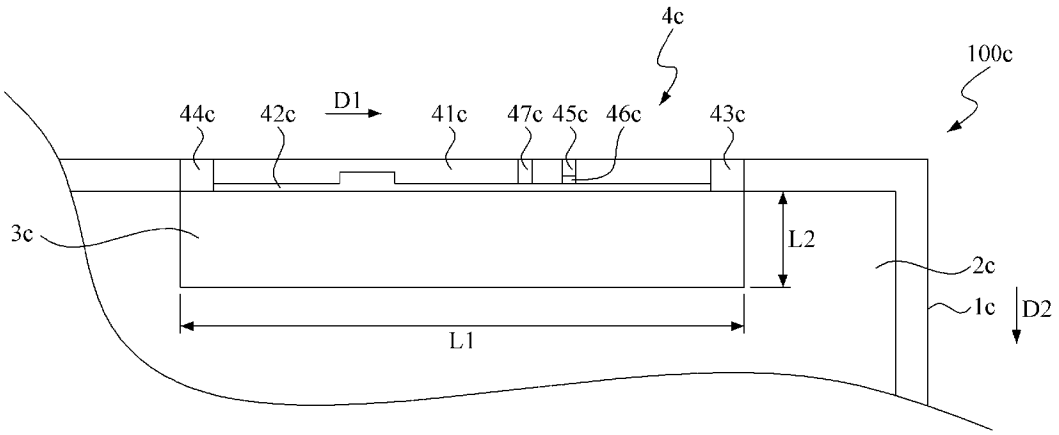
FIG. 9 is a partially enlarged schematic plan view of a communication device according to a fourth embodiment of the invention.
Figure 10:
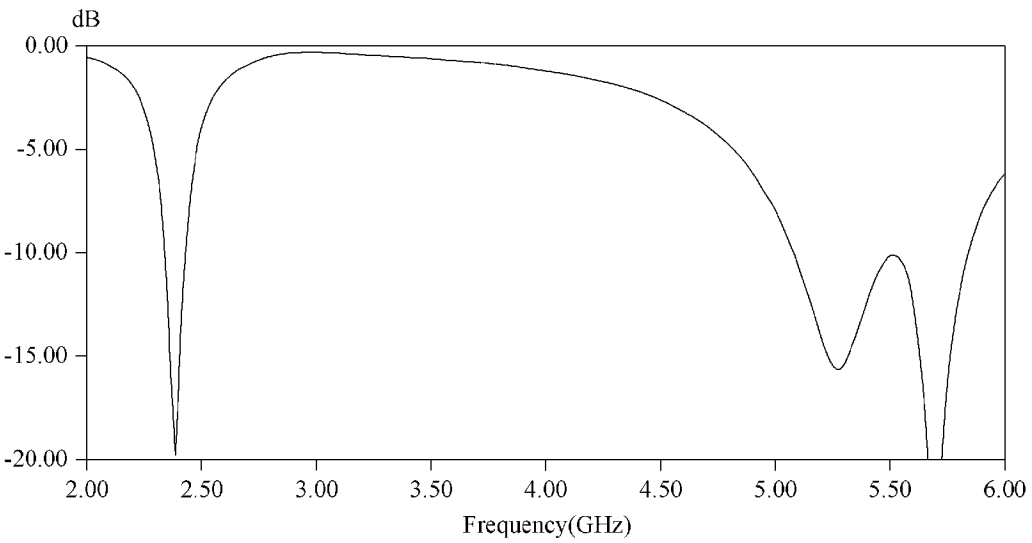
FIG. 10 is a diagram of return loss of a communication device at various operation frequencies according to a fourth embodiment of the invention.

Continuing to refer to FIG. 9 and FIG. 10, FIG. 9 is a partially enlarged schematic plan view of a communication device according to a fourth embodiment of the invention; and FIG. 10 is a diagram of return loss of the communication device at various operation frequencies according to the fourth embodiment of the invention.

As shown in the figures, a communication device 100*c* includes a metal rim 1*c*, an insulating member 2*c*, a device metal member 3*c*, and an antenna assembly 4*c*. The insulating member 2*c* is disposed in the metal rim 1*c*, and the device metal member 3*c* is disposed on the insulating member 2*c* and adjacent to the metal rim 1*c*.

The antenna assembly 4*c* also includes an insulating substrate 41*c*, a grounding part 42*c*, two electrical coupling portions 43*c* and 44*c*, a feeding part 45*c*, a feeding signal source 46*c*, and a matching part 47*c*. The feeding part 45*c* also divides a sealed slot section (not shown in the figure) enclosed by the metal rim 1*c*, the grounding part 42*c*, and the two electrical coupling portions 43*c* and 44*c* into a first slot section (not shown in the figure) and a second slot section (not shown in the figure). The first slot section is an area of the insulating substrate 41*c* between the feeding part 45*c* and the electrical coupling portion 44*c*, and the second slot section is an area of the insulating substrate 41*c* between the feeding part 45*c* and the electrical coupling portion 43*c*.

Based on the foregoing descriptions, in this embodiment, when the insulating member 2*c* built in the communication device 100*c* is an insulator not electrically conductive, the device metal member 3*c* can alternatively be fixedly disposed on the insulating member 2*c*. In addition, when the device metal member 3*c* is disposed on the insulating member 2*c*, the length L1 of the device metal member 3*c* in a first direction D1 is greater than a length of the grounding part 42*c* in the first direction, and the length L2 of the device metal member 3*c* in a second direction D2 is greater than 0.125 time a wavelength of an electromagnetic wave at a lowest frequency of a resonance mode of the first slot section in a first frequency band. Return loss of the antenna assembly 4*c* at various operation frequencies is shown in FIG. 10.

Figure 11:
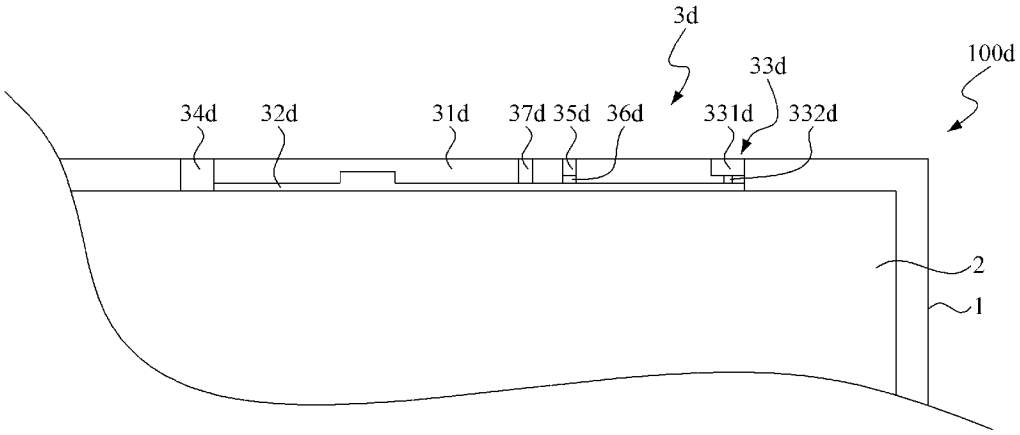
FIG. 11 is a partially enlarged schematic plan view of a communication device according to a fifth embodiment of the invention.
Figure 12:
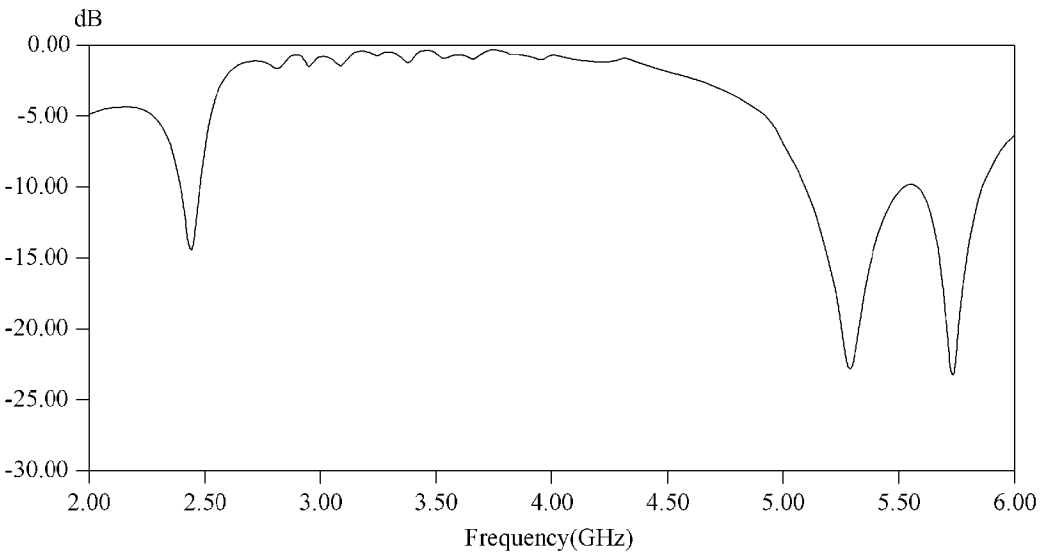
FIG. 12 is a diagram of return loss of a communication device at various operation frequencies according to a fifth embodiment of the invention.

Continuing to refer to FIG. 11 and FIG. 12, FIG. 11 is a partially enlarged schematic plan view of a communication device according to a fifth embodiment of the invention; and FIG. 12 is a diagram of return loss of the communication device at various operation frequencies according to the fifth embodiment of the invention.

As shown in the figures, a communication device 100*d* includes a metal rim 1, a device metal member 2, and an antenna assembly 3*d*. The communication device 100*d* is similar to the communication device 100 provided in the first embodiment. The antenna assembly 3*d* also includes an insulating substrate 31*d*, a grounding part 32*d*, two electrical coupling portions 33*d* and 34*d*, a feeding part 35*d*, a feeding signal source 36*d*, and a matching part 37*d*.

The difference between the antenna assembly 3*d* and the antenna assembly 3 is that the electrical coupling portion 33 is replaced with the electrical coupling portion 33*d* of the antenna assembly 3*d*, and the electrical coupling portion 33*d* includes a capacitor component 331*d* and an inductor component 332*d*. The capacitor component 331*d* is disposed on the insulating substrate 31*d* and electrically connected to the metal rim 1, and the inductor component 332 is disposed on the insulating substrate 31*d* and electrically connected to the capacitor component 331*d* and the grounding part 32*d*, so that the metal rim 1 can be electrically coupled to the grounding part 32*d* by using the capacitor component 331*d* and the inductor component 332*d* and further coupled to the device metal member 2. Return loss of the antenna assembly 3*d* at various operation frequencies is shown in FIG. 12. In an embodiment, the electrical coupling portion 33*d* can include a capacitor component, an inductor component, or a combination thereof, but this is not limited thereto.

Figure 13:
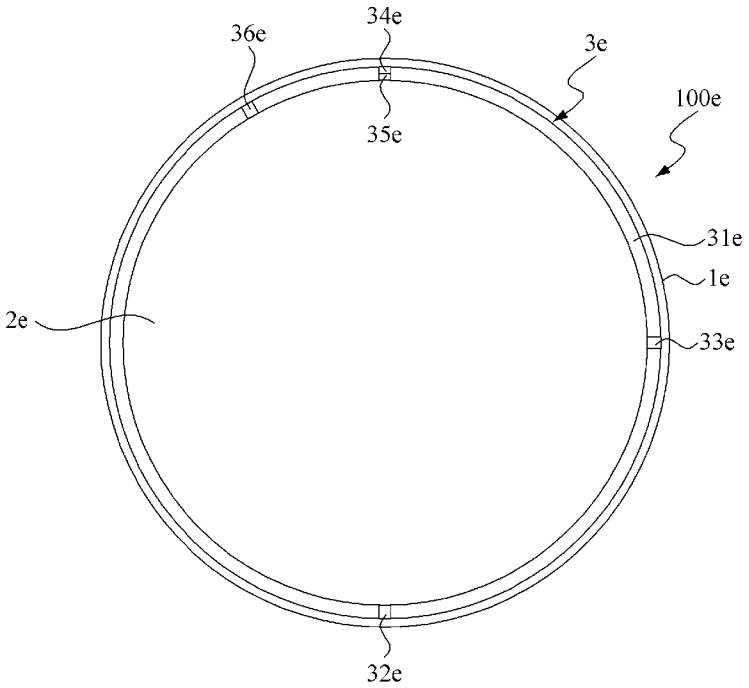
FIG. 13 is a schematic plan view of a communication device according to a sixth embodiment of the invention.

Continuing to refer to FIG. 13, FIG. 13 is a schematic plan view of a communication device according to a sixth embodiment of the invention. As shown in the figure, a communication device 100*e* includes a metal rim 1*e*, a device metal member 2*e*, and an antenna assembly 3*e*. The communication device 100*e* in this embodiment is a smartwatch.

The metal rim 1*e* in this embodiment is a watch metal housing. The device metal member 2*e* is disposed in the metal rim 1*e*. In this embodiment, the device metal member 2*e* is a metal panel inside the watch.

The antenna assembly 3*e* includes an insulating substrate 31*e*, two electrical coupling portions 32*e* and 33*e*, a feeding part 34*e*, a feeding signal source 35*e*, and a matching part 36*e*.

The insulating substrate 31*e* is disposed between the device metal member 2*e* and the metal rim 1*e*. During actual application, the insulating substrate 31*e* is an epoxy resin fiberglass substrate.

The two electrical coupling portions 32*e* and 33*e* are disposed at two opposite ends of the insulating substrate 31*e* and respectively electrically coupled to the device metal member 2*e* and the metal rim 1*e*, so that the two electrical coupling portions 32*e* and 33*e*, the device metal member 2*e*, and the metal rim 1*e* enclose a sealed slot section (not shown in the figure).

The feeding part 34*e* is disposed on the insulating substrate 31*e* and electrically coupled to the metal rim 1*e*, so as to divide the sealed slot section into a first slot section (not shown in the figure, that is, an arc section between the feeding part 34*e* and the electrical coupling portion 32*e*) and a second slot section (not shown in the figure, that is, an arc section between the feeding part 34*e* and the electrical coupling portion 33*e*), and the feeding part 34*e* is used for activating resonance modes of the first slot section in a first frequency band (approximately 2.4 GHz) and a second frequency band (approximately 5.2 GHz) and activating a resonance mode of the second slot section in a third frequency band (approximately 5.8 GHz).

The feeding signal source 35*e* is disposed on the insulating substrate 31*e*, located between the feeding part 34*e* and the device metal member 2*e*, and electrically coupled to the feeding part 34*e* and the device metal member 2*e*.

The matching part 36*e* is disposed in the first slot section, adjacent to the feeding part 34*e*, and electrically coupled to the metal rim 1*e* and the device metal member 2*e*. The matching part 36*e* is used for optimizing an operation frequency and a frequency bandwidth of the resonance mode generated by the first slot section or the second slot section. In addition, during actual application, the matching part 36*e* is an element such as a resistor, an inductor, or a capacitor.

In conclusion, in the invention, the antenna assembly is disposed in a sealed space enclosed by the metal rim and the device metal member, and the two electrical coupling portions of the antenna assembly are used to enclose the sealed slot section, so that the insulating substrate disposed in the sealed slot section can be divided into the first slot section and the second slot section by the feeding part, thereby generating resonance modes in different frequency bands in a limited space. Compared with the prior art in which antennas are mostly disposed on housings or device bodies of mobile devices, in the invention, a setting manner in which the antenna assembly cooperates with the device metal member and the metal rim can indeed achieve a function of the antenna by effectively using the limited space.

The foregoing is merely embodiments of the invention, and is not construed as any limitation to the invention. Variations such as equivalent replacements or modifications of any form made on the technical solutions and technical content disclosed in the invention by any person skilled in the art without departing from the scope of the technical solutions of the invention all belong to content not departing from the technical solutions of the invention and still fall within the protection scope of the invention.

What is claimed is:

1. A communication device, comprising:

a metal rim;

a device metal member, disposed in the metal rim; and an antenna assembly, comprising:

an insulating substrate, disposed between the device metal member and the metal rim;

two electrical coupling portions, disposed at two opposite ends of the insulating substrate and electrically coupled to the device metal member and the metal rim, a sealed slot section is enclosed by the two electrical coupling portions, the device metal member, and the metal rim;

a feeding part, disposed on the insulating substrate and electrically coupled to the metal rim, so as to divide the sealed slot section into a first slot section and a second slot section whose length is less than that of the first slot section, the feeding part is configured to activate resonance modes of the first slot section in a first frequency band and a second frequency band and activate a resonance mode of the second slot section in a third frequency band; and a feeding signal source, disposed on the insulating substrate, located between the feeding part and the device metal member, and electrically coupled to the feeding part and the device metal member.

2. The communication device according to claim 1, wherein the antenna assembly further comprises a grounding part, disposed on the insulating substrate and electrically coupled to the device metal member, the two electrical coupling portions, and the feeding signal source.

3. The communication device according to claim 2, further comprising an insulating member, wherein the insulating member is disposed in the metal rim, and the device metal member is disposed on the insulating member.

4. The communication device according to claim 3, wherein the length of the device metal member in a first direction is greater than the length of the grounding part in the first direction, and the length of the device metal member in a second direction perpendicular to the first direction is greater than 0.125 time a wavelength of an electromagnetic wave at a lowest frequency in the first frequency band.

5. The communication device according to claim 2, wherein the antenna assembly further comprises a matching part, disposed in the first slot section, adjacent to the feeding part and electrically coupled to the metal rim and the grounding part.

6. The communication device according to claim 2, wherein the two electrical coupling portions are respectively electrically coupled to the grounding part.

7. The communication device according to claim 1, wherein the two electrical coupling portions comprise a capacitor component, an inductor component, or a combination thereof.

8. An antenna assembly, applied to a communication device, the communication device comprising a metal rim and a device metal member, the device metal member being disposed in the metal rim, and the antenna assembly comprising:

an insulating substrate, disposed between the device metal member and the metal rim;

two electrical coupling portions, disposed at two opposite ends of the insulating substrate and electrically coupled to the device metal member and the metal rim, a sealed slot section is enclosed by the two electrical coupling portions, the device metal member, and the metal rim;

a feeding part, disposed on the insulating substrate and electrically coupled to the metal rim, so as to divide the sealed slot section into a first slot section and a second slot section whose length is less than that of the first slot section, the feeding part is configured to activate resonance modes of the first slot section in a first frequency band and a second frequency band and activate a resonance mode of the second slot section in a third frequency band; and a feeding signal source, disposed on the insulating substrate, located between the feeding part and the device metal member, and electrically coupled to the feeding part and the device metal member.

9. The antenna assembly according to claim 8, further comprising a grounding part, disposed on the insulating substrate and electrically coupled to the device metal member, the two electrical coupling portions, and the feeding signal source.

10. The antenna assembly according to claim 9, further comprising a matching part, disposed in the first slot section, adjacent to the feeding part, and electrically coupled to the metal rim and the grounding part.

* * * * *